US006468186B2

(12) United States Patent
Lay

(10) Patent No.: US 6,468,186 B2
(45) Date of Patent: Oct. 22, 2002

(54) ADJUSTABLE MAGNETIC DAMPING DEVICE FOR A STATIONARY BICYCLE

(76) Inventor: Gwo-Rong Lay, No. 24, Alley 1, Lane 21, Sec. 2, Fu-Shing Rd., Tan-Tz Town, Tai-Chung Hsien (TW)

( * ) Notice: Subject to any disclaimer, the term of this patent is extended or adjusted under 35 U.S.C. 154(b) by 146 days.

(21) Appl. No.: 09/730,249

(22) Filed: Dec. 5, 2000

(65) Prior Publication Data

US 2001/0003110 A1 Jun. 7, 2001

(30) Foreign Application Priority Data

Dec. 6, 1999 (TW) ..... 088220926 U

(51) Int. Cl.[7] ..... A63B 22/06; B60L 7/00
(52) U.S. Cl. ..... 482/63; 188/161
(58) Field of Search ..... 482/63, 57, 65, 482/1–10; 188/161, 164, 267

(56) References Cited

U.S. PATENT DOCUMENTS 5,848,973 A * 12/1998 Wei et al. ..... 482/63
5,851,165 A * 12/1998 Wei et al. ..... 482/63
5,879,273 A * 3/1999 Wei et al. ..... 482/63
6,273,845 B1 * 8/2001 Liou ..... 482/63
6,360,855 B1 * 3/2002 Szu-yin ..... 188/161

* cited by examiner

*Primary Examiner*—Stephen R. Crow
(74) *Attorney, Agent, or Firm*—Charles E. Baxley

(57) ABSTRACT

An adjustable magnetic damping device formed of a left cover shell, a plurality of adjustment members, a plurality of magnets, a cam wheel, and a right cover shell, and installed in the flywheel of a stationary bicycle adjacent to a metal lining of the flywheel to impart a damping resistance to the flywheel. The cam wheel is connected to a pull cable of which the tension can be adjusted for enabling the angular position of the cam wheel to be changed, so as to further adjust the radial position of the magnets in changing the strength of the magnetic resistance.

7 Claims, 9 Drawing Sheets

ADJUSTABLE MAGNETIC DAMPING DEVICE FOR A STATIONARY BICYCLE

BACKGROUND OF THE INVENTION

The present invention relates to a magnetic damping device for a stationary bicycle and, more particularly, to an adjustable magnetic damping device that can be conveniently controlled to adjust the damping resistance.

A conventional stationary bicycle, as shown in FIG. 1, uses a damping belt to impart a damping resistance to the flywheel. The damping belt has one end fixedly fastened to the frame of the stationary bicycle, and the other end connected to an adjustment knob. By means of operating the adjustment knob to adjust the tension of the damping belt, the damping resistance is relatively adjusted. The service life of the damping belt is short because it wears quickly with use. During the operation of the stationary bicycle, a high noise is produced due to friction between the damping belt and the flywheel. Further, because the damping force is not thoroughly evenly distributed to the periphery of the flywheel, the flywheel may displace when rotated, thereby causing the stationary bicycle to vibrate.

SUMMARY OF THE INVENTION

The present invention has been accomplished to provide an adjustable magnetic damping device for a stationary bicycle, which eliminates the aforesaid drawbacks. It is one object of the present invention to provide an adjustable magnetic damping device for a stationary bicycle, which is durable in use. It is another object of the present invention to provide an adjustable magnetic damping device for a stationary bicycle, which keeps the stationary bicycle operated stably without producing noise. According to one aspect of the present invention, magnets are mounted on respective adjustment members and equiangularly spaced around a fixed shaft to attract a fixed metal lining at the inside wall of the flywheel of the stationary bicycle, so as to impart a damping resistance evenly to the flywheel, enabling the flywheel to be rotated smoothly on a fixed shaft. According to another aspect of the present invention, a cam wheel is connected to a pull cable and controlled to move the adjustment members and the magnets radially around the fixed shaft on which the flywheel is supported, enabling the damping resistance to be conveniently adjusted.

DETAILED DESCRIPTION OF THE PREFERRED EMBODIMENT

Figure 1:
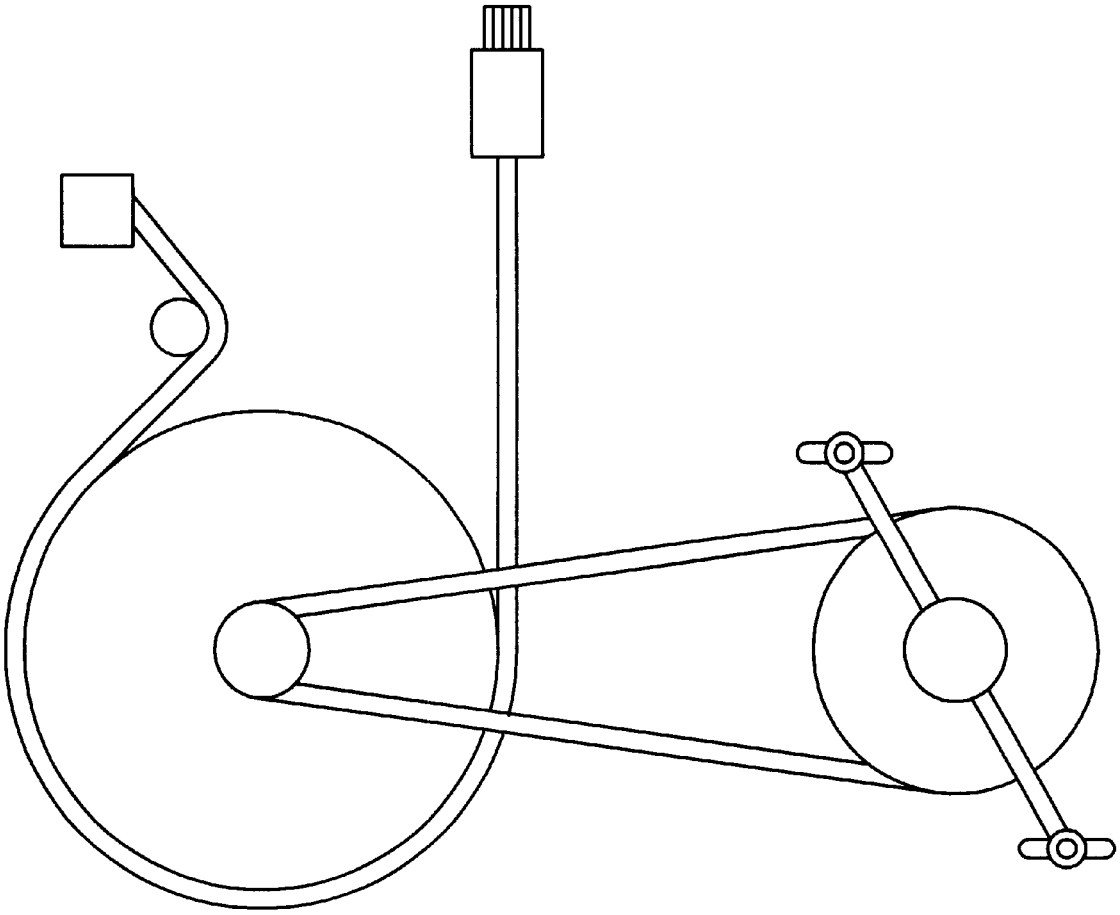
FIG. 1 PRIOR ART
FIG. 1 illustrates a damping belt secured to the flywheel of a stationary bicycle according to the prior art.
Figure 2:
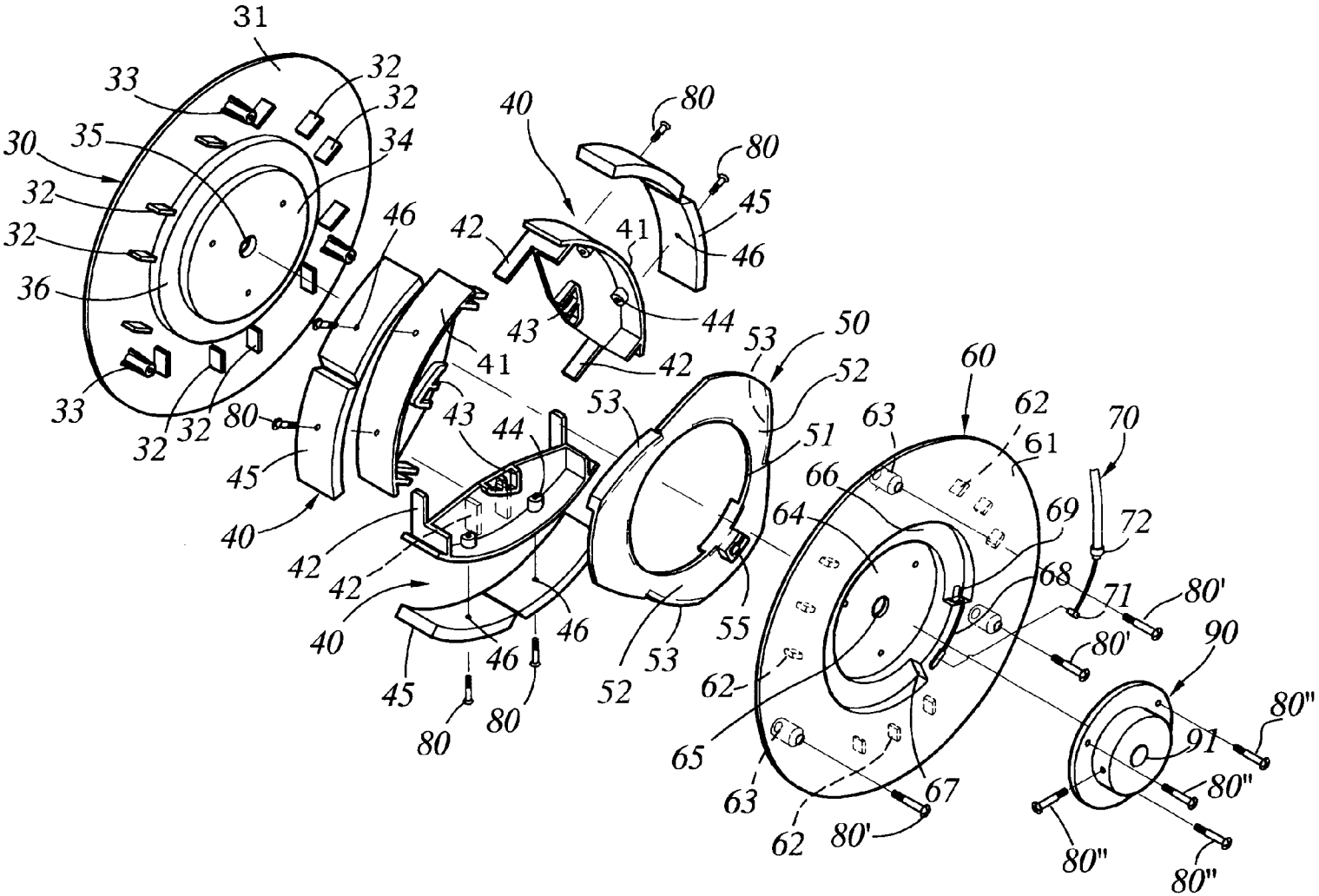
FIG. 2 is an exploded view of an adjustable damping device according to the present invention.
Figure 3:
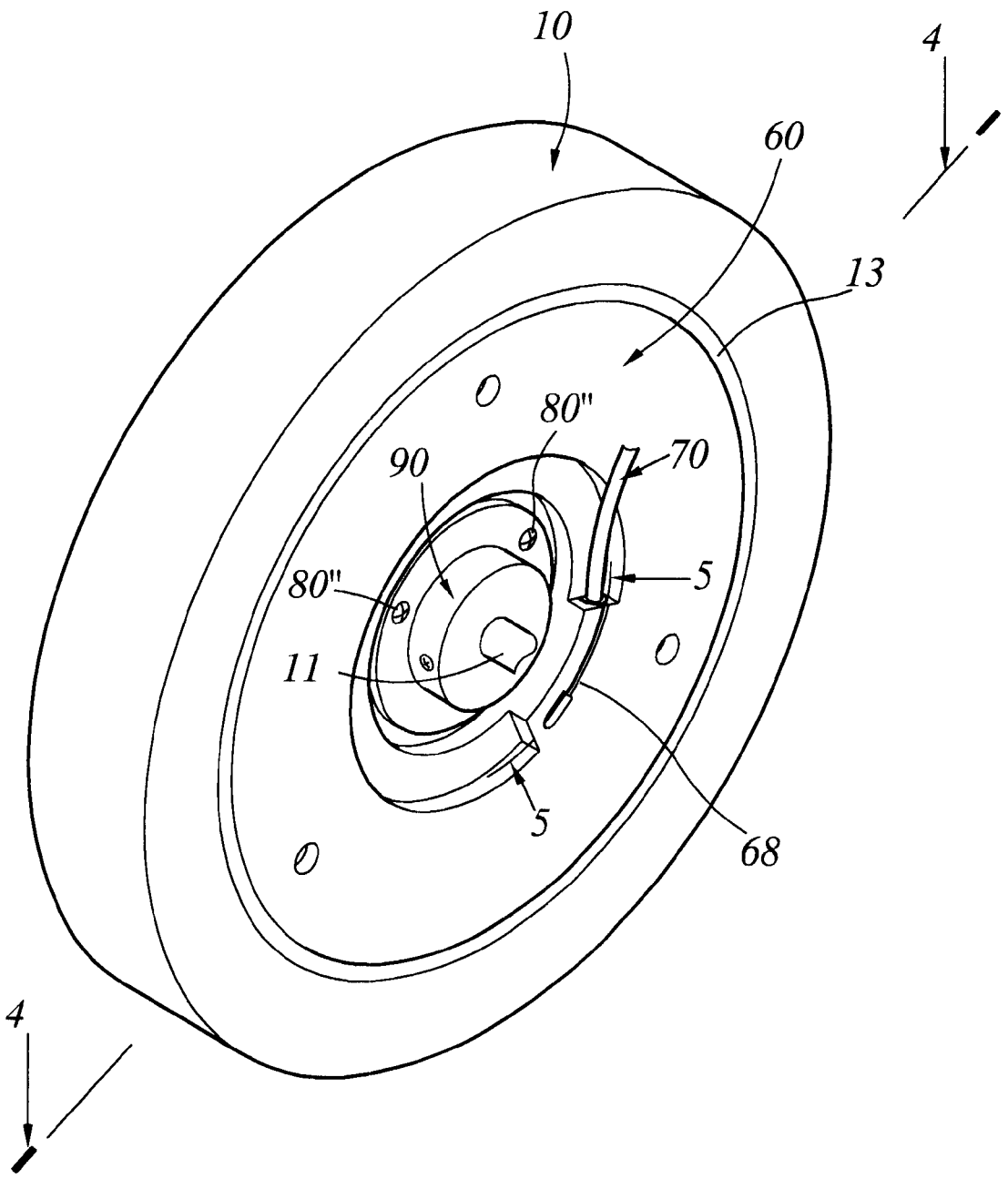
FIG. 3 is an elevational view showing the adjustable damping device installed in the flywheel according to the present invention.
Figure 4:
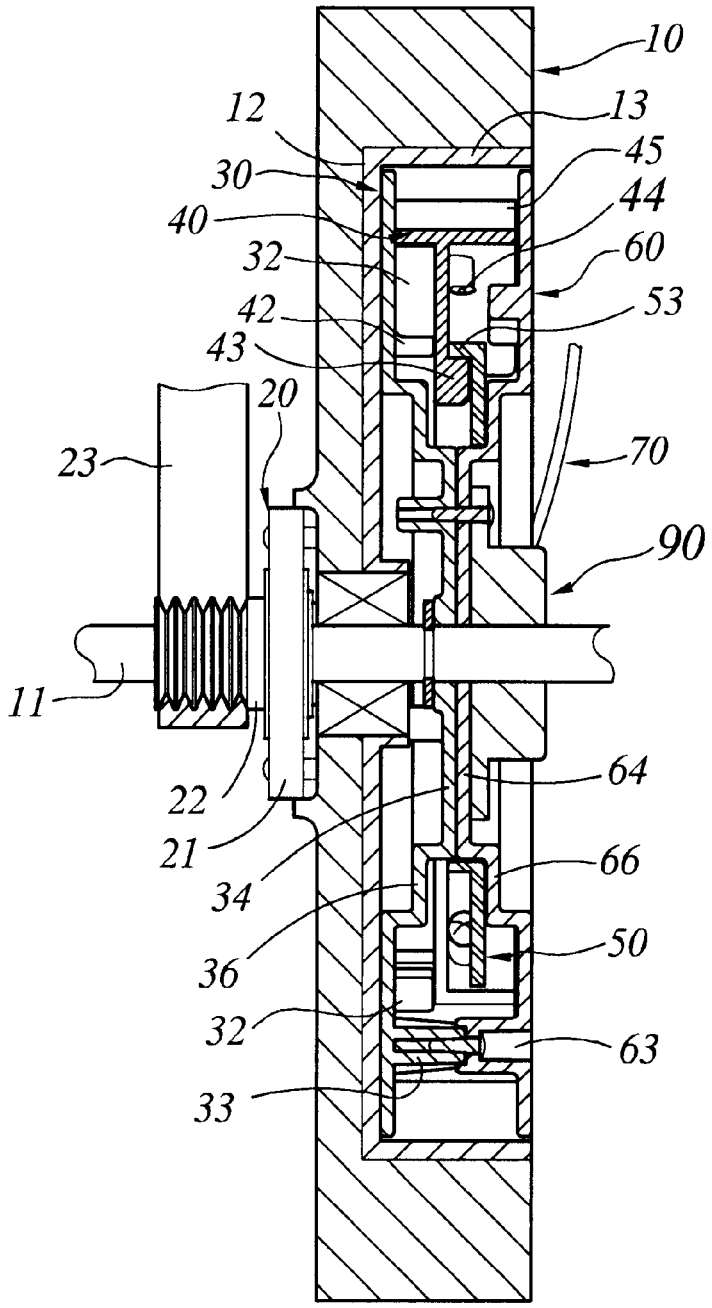
FIG. 4 is a sectional view taken along line 4—4 of FIG. 3.

Referring to FIGS. from 2 through 4, a flywheel 10 is installed in a stationary bicycle (not shown) to hold a magnetic damping device, and a ratchet mechanism 20 is provided to control one-way rotation of the flywheel 10. The flywheel 10 is supported on a fixed shaft 11, having a solid wheel body 12 and metal lining 13 fastened to the inside wall of the wheel body 12 and defining a receiving chamber adapted to hold the magnetic damping device. The ratchet mechanism 20 is comprised of a ratchet wheel 21 fixedly fastened to an outer side of the solid wheel body 12 of the flywheel 10, a transmission shaft 22, and a transmission belt 23. Because the ratchet mechanism 20 is of the known art and not within the scope of the claims of the present invention, it is not described in detail. The magnetic damping device is comprised of a left cover shell 30, a plurality of adjustment members 40, a plurality of magnets 45, a cam wheel 50, a right cover shell 60, a pull cable 70, and a cap 90.

Figure 5:
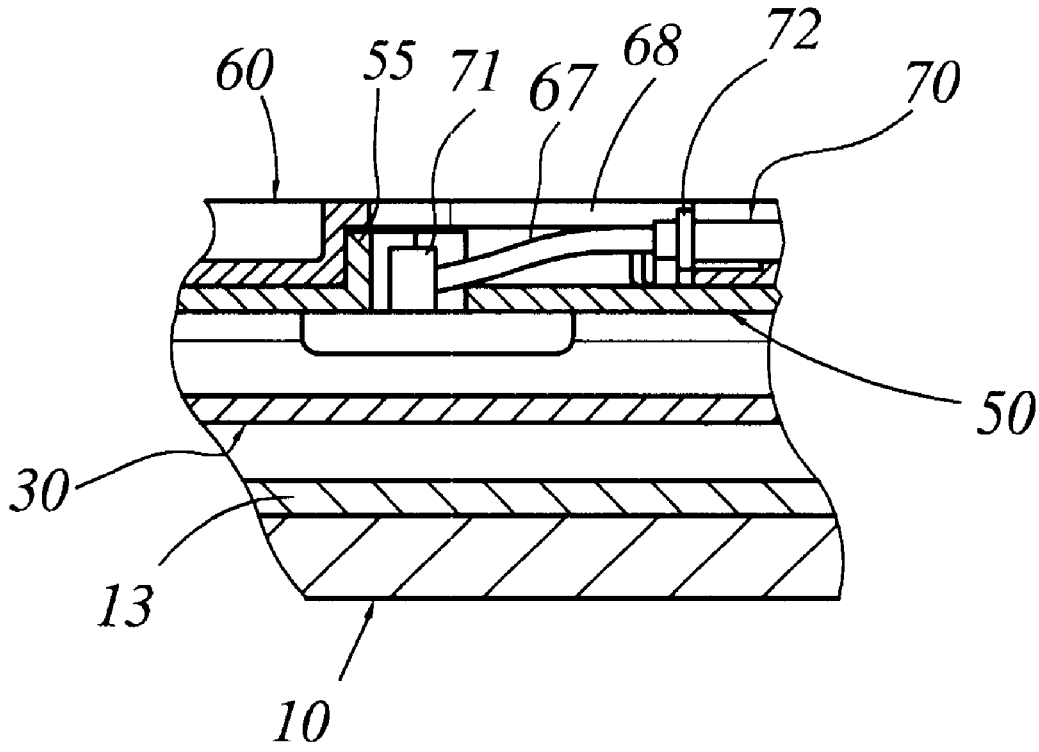
FIG. 5 is a sectional view taken along line 5—5 of FIG. 3.

The left cover shell 30 comprises a disk-like body 31. The disk-like body 31 comprises a first circular flange 36 protruded from an inner side thereof, a second circular flange 34 protruded from the first circular flange 36, a pivot hole 35 at the center of the second circular flange 34, which receives the fixed shaft 11, a plurality of parallel guide blocks 32 disposed at the inner side and equiangularly spaced around the first circular flange 36, and a plurality of mounting posts 33 disposed at the inner side and equiangularly spaced around the border area. The adjustment members 40 each comprise a sector-like base 41, a plurality of rails 42 moved with the sector-like base 41 in between the guide blocks 32, a wedge-like push block 43, and two mounting holes 44. The magnets 45 are smoothly arched members, each comprising two mounting holes 46 respectively fastened to the mounting holes 44 of the adjustment members 40 by screws 80. The cam wheel 50 comprises a circular center opening 51 coupled to the second circular flange 34 of the left cover shell 30 for enabling the cam wheel 50 to be rotated on the second circular flange 34, a plurality of blades 52 formed integral with one another around the circular center opening 51, a plurality of peripheral flanges 53 respectively formed on the blades 52 at an outer side, and a pull cable holder 55 disposed at the right side. The right cover shell 60 comprises a disk-like body 61. The disk-like body 61 comprises a first circular flange 66 protruded from an inner side thereof, a second circular flange 64 protruded from the first circular flange 66 and inserted into the circular center opening 51 of the cam wheel 50 in contact with the second circular flange 34 of the left cover shell 30, a pivot hole 65 at the center of the second circular flange 64, which receives the fixed shaft 11, a plurality of parallel guide blocks 62 disposed at the inner side and equiangularly spaced around the first circular flange 66, a plurality of mounting posts 63 disposed at the inner side and respectively fastened to the mounting posts 33 of the left cover shell 30 by screws 80', a wire slot 68 formed in the first circular flange 66, a receiving space 67 defined around the wire slot 68 and adapted to receive the pull cable holder 53 of the cam wheel 50, and a retainer 69 at one end of the wire slot 68. The pull cable 70 comprises a shell 72 fixedly fastened to the retainer 69 of the right cover shell 60, and a core 71 inserted through the wire slot 68 and fastened to the pull cable holder 55 of the cam wheel 50 (see FIG. 5). The cap 90 is attached to the right cover shell 60 and fixed to the fixed shaft 11 by holding down screws 80", having a center through hole 91 for the passing of the fixed shaft 11.

Figure 6:
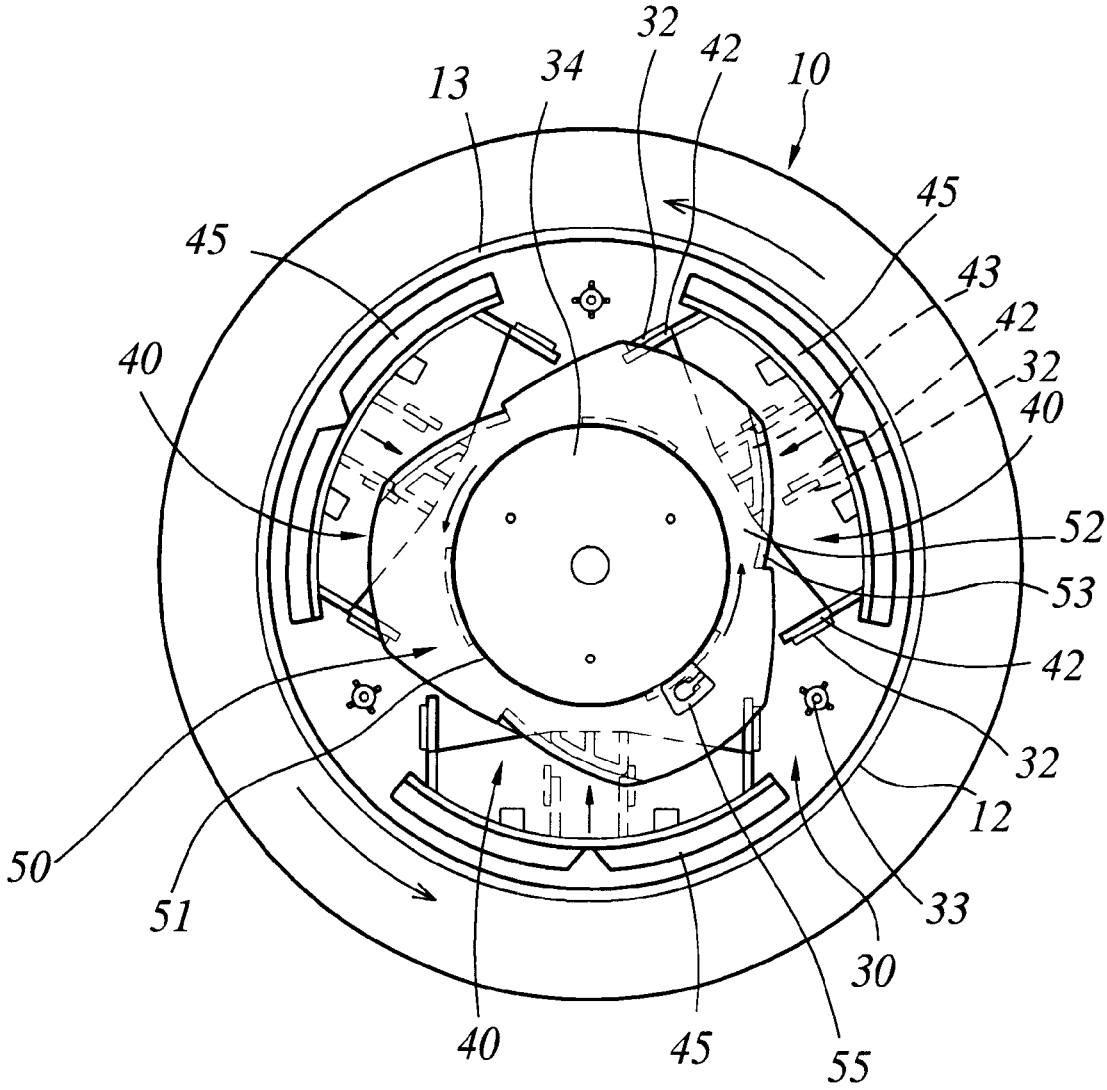
FIG. 6 is a schematic drawing showing an inward adjustment of the magnets according to the present invention.

Referring to FIG. 6, when adjusting the pull cable 70 to increase its tension, the cam wheel 50 is rotated on the second circular flange 34 of the left cover shell 30 and the second circular flange 64 of the right cover shell 60 in one direction through an angle, and at the same time the peripheral flanges 53 of the blades 52 of the cam wheel 50 move the wedge-like push blocks 43 of the adjustment members 40 synchronously to widen the distance between the magnets 45 and the metal lining 13 of the flywheel 10, and therefore the damping resistance is relatively reduced.

Figure 7:
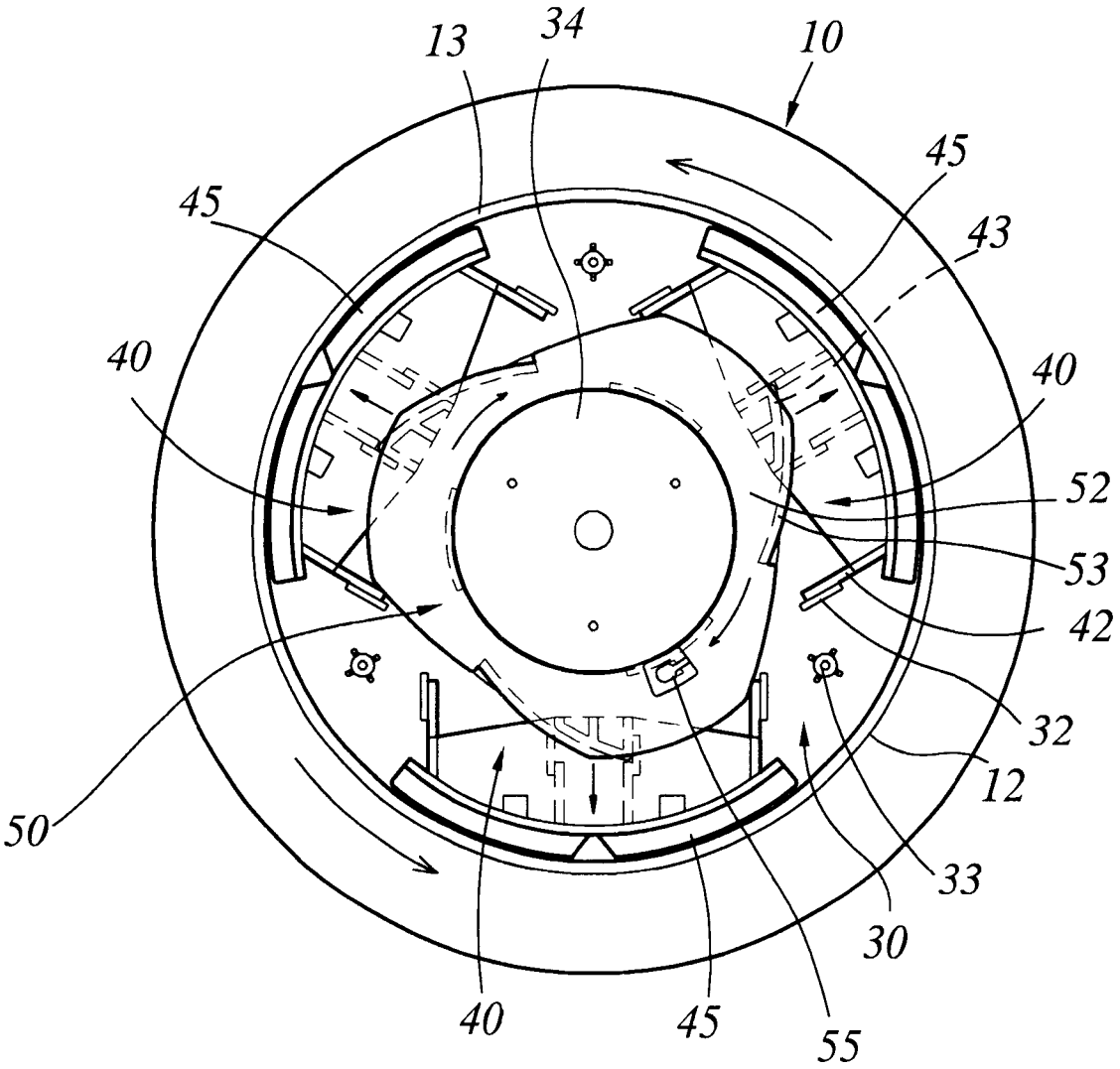
FIG. 7 is a schematic drawing showing an outward adjustment of the magnets according to the present invention.

Referring to FIG. 7, when adjusting the pull cable 70 to release its tension, the cam wheel 50 is rotated on the second circular flange 34 of the left cover shell 30 and the second circular flange 64 of the right cover shell 60 in the reversed direction through an angle by means of the effect of the magnetic attractive force induced between the magnets 45 and the flywheel 10, and therefore the distance between the magnets 45 and the metal lining 13 of the flywheel 10 is relatively shortened to increase the damping resistance.

Figure 8:
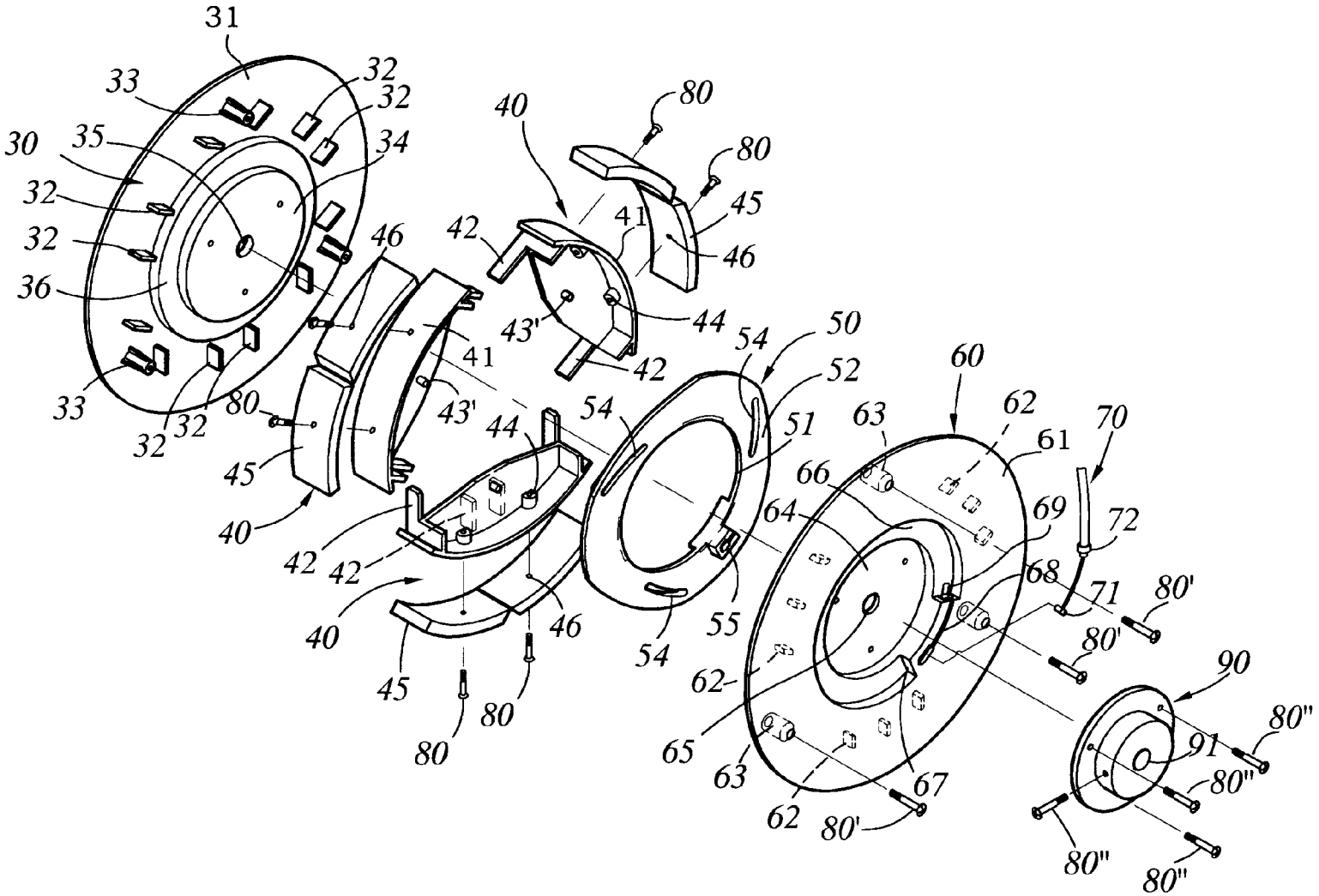
FIG. 8 is an exploded view of an alternate form of the present invention.
Figure 9:
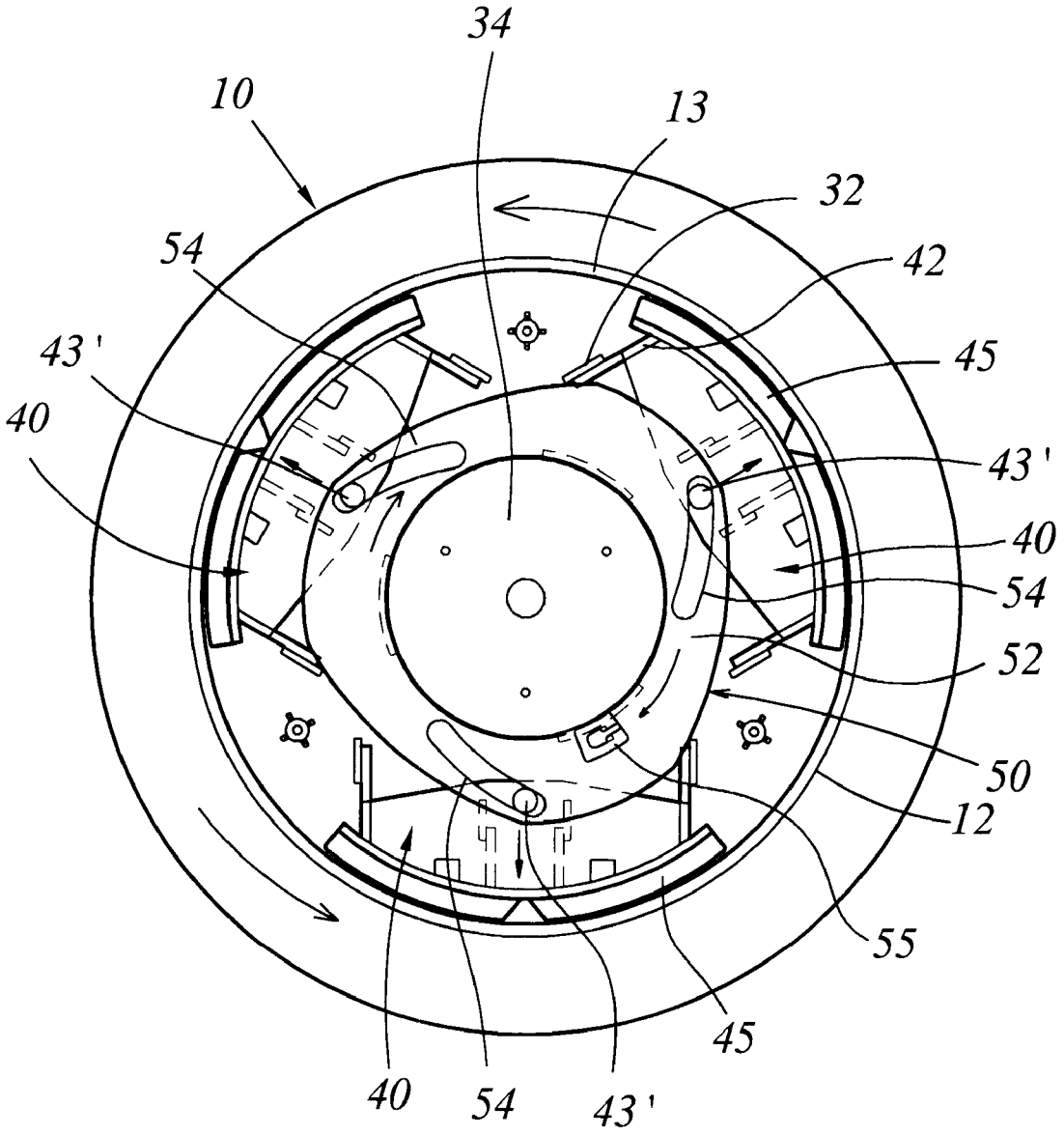
FIG. 9 is a side plain view of the alternate form of the present invention.

FIGS. 8 and 9 show an alternate form of the present invention. According to this alternate form, the push block 43' of each adjustment member 40 has a cylindrical shape, and the blades 52 of the cam wheel 50 each have a locating groove 54 adapted to receive the push block 43' of one adjustment member 40.

It is to be understood that the drawings are designed for purposes of illustration only, and are not intended for use as a definition of the limits and scope of the invention disclosed.

What the invention claimed is:

1. An adjustable magnetic damping device installed in a flywheel supported on a fixed shaft of a stationary bicycle, said flywheel comprising a solid wheel body and metal lining fastened to the wheel body and defining a receiving chamber adapted to hold the magnetic damping device, the magnetic damping device comprising:

a left cover shell, said left cover shell comprising a first circular flange protruded from an inner side thereof, a second circular flange protruded from the first circular flange of said left cover shell, a pivot hole at the center of the second circular flange of said left cover shell, which receives the fixed shaft of the stationary bicycle, a plurality of parallel guide blocks disposed at the inner side and equiangularly spaced around the first circular flange of said left cover shell, and a plurality of mounting posts disposed at the inner side and equiangularly spaced around the border area of said left cover shell;

a plurality of adjustment members, said adjustment members each comprising a sector-like base, a plurality of rails extended from said sector-like base and inserted in between the guide blocks of said left cover shell, and a wedge-like push block;

a plurality of smoothly arched magnets respectively fixedly fastened to said adjustment members at an outer side to attract the metal lining of said flywheel;

a cam wheel, said cam wheel comprising a circular center opening coupled to the second circular flange of said left cover shell, a plurality of blades formed integral with one another around said circular center opening and respectively attached to the push block of each of said adjustment members, and a pull cable holder;

a right cover shell, said right cover shell comprising a first circular flange protruded from an inner side thereof, a second circular flange protruded from the first circular flange of said right cover shell and inserted into the circular center opening of said cam wheel in contact with the second circular flange of said left cover shell, a pivot hole at the center of the second circular flange of said right cover shell, which receives the fixed shaft of said stationary bicycle, a plurality of parallel guide blocks disposed at the inner side and adapted to guide radial movement of said adjustment members, a plurality of mounting posts disposed at the inner side and respectively fastened to the mounting posts of said left cover shell by fastening elements, and a wire slot formed in the first circular flange of said right cover shell for the insertion of a pull cable for enabling the pull cable to be fastened to the pull cable holder of said cam wheel.

2. The adjustable magnetic damping device of claim 1, wherein said right cover shell comprises a receiving space defined around said wire slot and adapted for receiving said pull cable holder for enabling said cam wheel to be rotated through a limited angle.

3. The adjustable magnetic damping device of claim 2 wherein said right cover shell further comprises a retainer disposed at one end of said wire slot and adapted to hold the shell of the pull cable being connected to the pull cable holder of said cam wheel.

4. The adjustable magnetic damping device of claim 1, wherein the blades of said cam wheel each comprise a peripheral flange attached to the push block of one of said adjustment members.

5. The adjustable magnetic damping device of claim 4, wherein the push block of each of said adjustment member has a wedge-like shape.

6. The adjustable magnetic damping device of claim 1, wherein the blades of said cam wheel each comprise a locating groove, which receives the push block of one of said adjustment members.

7. The adjustable magnetic damping device of claim 6, where the push block of each of said adjustment member has a cylindrical shape.

* * * * *